US012760388B2

(12) United States Patent
Kong et al.

(10) Patent No.: US 12,760,388 B2
(45) Date of Patent: Oct. 13, 2026

(54) COLD ROLLED STEEL SHEET AND MANUFACTURING METHOD THEREFOR

(71) Applicant: POSCO CO., LTD, Gyeongsangbuk-do (KR)

(72) Inventors: Jong-Pan Kong, Gwangyang-si (KR); Young-Roc Im, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 18/711,439

(22) PCT Filed: Nov. 7, 2022

(86) PCT No.: PCT/KR2022/017337

§ 371 (c)(1),
(2) Date: May 17, 2024

(87) PCT Pub. No.: WO2023/090736

PCT Pub. Date: May 25, 2023

(65) Prior Publication Data

US 2025/0003022 A1 Jan. 2, 2025

(30) Foreign Application Priority Data

Nov. 19, 2021 (KR) ..... 10-2021-0160095

(51) Int. Cl.
*C22C 38/02* (2006.01)
*C21D 1/18* (2006.01)
(Continued)

(52) U.S. Cl.
CPC ..... *C21D 9/46* (2013.01); *C21D 1/18* (2013.01); *C21D 1/74* (2013.01); *C21D 1/84* (2013.01);
(Continued)

(58) Field of Classification Search
CPC ..... C22C 38/02; C22C 38/04; C22C 38/06; C22C 38/22; C22C 38/26; C22C 38/28;
(Continued)

(56) References Cited

U.S. PATENT DOCUMENTS 11,473,164 B2 10/2022 Nishio et al.
2006/0011274 A1 1/2006 Speer et al.
(Continued)

FOREIGN PATENT DOCUMENTS

CN 111647732 A 9/2020
EP 3556896 A1 10/2019
(Continued)

OTHER PUBLICATIONS

International Search Report and Written Opinion dated Feb. 13, 2023 issued in International Patent Application No. PCT/KR2022/017337 (with English translation).
(Continued)

*Primary Examiner* — Katherine A Christy
(74) *Attorney, Agent, or Firm* — Morgan Lewis & Bockius LLP

(57) ABSTRACT

A cold rolled steel sheet including, by weight: C: 0.10 to 0.20%, Si: 0.05 to 0.495%, Al: 0.01 to 0.18%, Mn: 2.4 to 3.5%, Cr: 0.05 to 0.8%, Mo: 0.05 to 0.8%, B: 0.0001 to 0.003%, Nb: 0.005 to 0.07%, Ti: 0.005 to 0.07%, with a remainder of Fe and other unavoidable impurities. The cold-rolled steel sheet has a tensile strength (TS): 1185 to 1400 MPa, and a yield ratio (YS/TS): 0.70 or more. The cold-rolled steel sheet has a microstructure including, by area: fresh martensite: 1 to 11%, one or two of tempered martensite and bainite: 80 to 97%, retained austenite: 1 to 9%, and ferrite: 7% or less (including 0%). The microstructure includes at least one of MC, M(C,N), and their com-
(Continued)

posite precipitates (M=Nb, Ti, Si, Cr, Mo, Fe) with an average size of 20 nm or less in a fraction of 50/$\mu m^2$ or more.

9 Claims, 4 Drawing Sheets

(51) Int. Cl.

| | |
|---|---|
| ***C21D 1/74*** | (2006.01) |
| ***C21D 1/84*** | (2006.01) |
| ***C21D 6/00*** | (2006.01) |
| ***C21D 8/02*** | (2026.01) |
| ***C21D 8/021*** | (2026.01) |
| ***C21D 8/0221*** | (2026.01) |
| ***C21D 8/0247*** | (2026.01) |
| ***C21D 8/0278*** | (2026.01) |
| ***C21D 9/46*** | (2006.01) |
| ***C22C 38/04*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C23C 2/02*** | (2006.01) |
| ***C23C 2/26*** | (2006.01) |
| ***C23C 2/40*** | (2006.01) |

(52) U.S. Cl.
CPC ..... *C21D 6/002* (2013.01); *C21D 6/005* (2013.01); *C21D 6/008* (2013.01); *C21D 8/02* (2013.01); *C21D 8/021* (2013.01); *C21D 8/0226* (2013.01); *C21D 8/0236* (2013.01); *C21D 8/0263* (2013.01); *C21D 8/0278* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01); *C22C 38/32* (2013.01); *C22C 38/38* (2013.01); *C23C 2/0224* (2022.08); *C23C 2/26* (2013.01); *C23C 2/40* (2013.01); *C21D 2211/001* (2013.01); *C21D 2211/002* (2013.01); *C21D 2211/005* (2013.01); *C21D 2211/008* (2013.01)

(58) Field of Classification Search
CPC ... C22C 38/32; C22C 38/38; C21D 2211/001; C21D 2211/002; C21D 2211/005; C21D 2211/008
USPC ..... 428/613
See application file for complete search history.

(56) References Cited

U.S. PATENT DOCUMENTS

| | | | |
|---|---|---|---|
| 2018/0002771 | A1 | 1/2018 | Han et al. |
| 2018/0371570 | A1 | 12/2018 | Kim et al. |
| 2020/0190612 | A1 | 6/2020 | Kwak et al. |
| 2020/0270713 | A1 | 8/2020 | Gospodinova et al. |
| 2021/0355559 | A1 | 11/2021 | Ono et al. |
| 2021/0381076 | A1 | 12/2021 | Kohsaka et al. |
| 2021/0381077 | A1 | 12/2021 | Kohsaka et al. |
| 2022/0033926 | A1 | 2/2022 | Im et al. |
| 2022/0090248 | A1 | 3/2022 | Yokoyama et al. |
| 2022/0259691 | A1 | 8/2022 | Im et al. |
| 2022/0349019 | A1 | 11/2022 | Im et al. |
| 2023/0141248 | A1 | 5/2023 | Inacio Da Rosa et al. |

FOREIGN PATENT DOCUMENTS

| | | | | | |
|---|---|---|---|---|---|
| EP | 3653738 | A1 | | 5/2020 | |
| EP | 3770292 | A1 | | 1/2021 | |
| EP | 3859041 | A1 | | 8/2021 | |
| JP | 2528387 | A | | 8/1996 | |
| JP | 2005-068548 | A | | 3/2005 | |
| JP | 2005-264176 | A | | 9/2005 | |
| JP | 2013-227657 | A | | 11/2013 | |
| JP | 2014-196557 | A | | 10/2014 | |
| JP | 2016-216808 | A | | 12/2016 | |
| JP | 2019-504196 | A | | 2/2019 | |
| JP | 2021-025094 | A | | 2/2021 | |
| JP | 2022-540208 | A | | 9/2022 | |
| JP | 2022-540210 | A | | 9/2022 | |
| JP | 2023-508240 | A | | 3/2023 | |
| KR | 10-2015-0073844 | A | | 7/2015 | |
| KR | 10-1858852 | B1 | | 6/2018 | |
| KR | 20200036759 | A | * | 4/2020 | ..... C21D 8/0226 |
| KR | 10-2021-0058918 | A | | 5/2021 | |
| KR | 10-2021-0059746 | A | | 5/2021 | |
| KR | 10-2021-0059748 | A | | 5/2021 | |
| KR | 10-2021-0086686 | A | | 7/2021 | |
| KR | 10-2276741 | B1 | | 7/2021 | |
| WO | 2018/038045 | A1 | | 3/2018 | |
| WO | 2021/176249 | A1 | | 9/2021 | |

OTHER PUBLICATIONS

The Extended European Search Report dated Jan. 30, 2025 issued in European Patent Application No. 22895943.3.
Office Action dated Aug. 5, 2025, issued in corresponding Japanese Patent Application No. 2024-529592, with an English translation.

* cited by examiner

[FIG. 1]
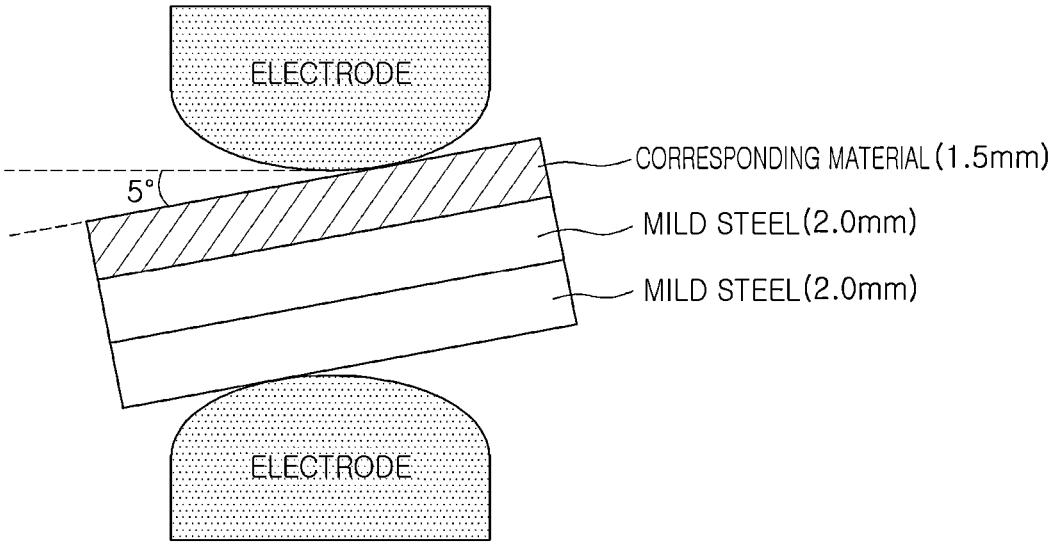

[FIG. 2]
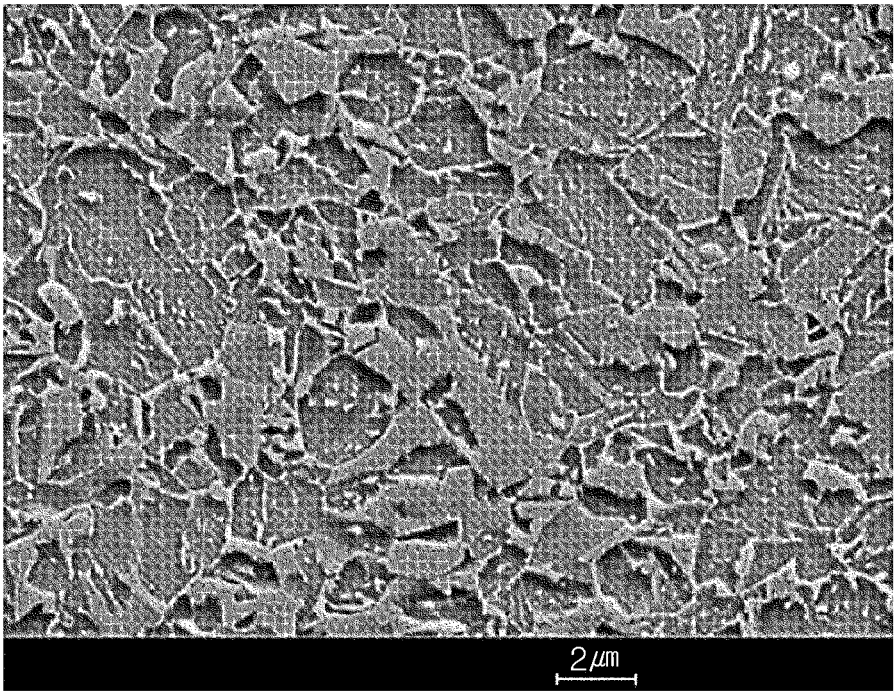

[FIG. 3]
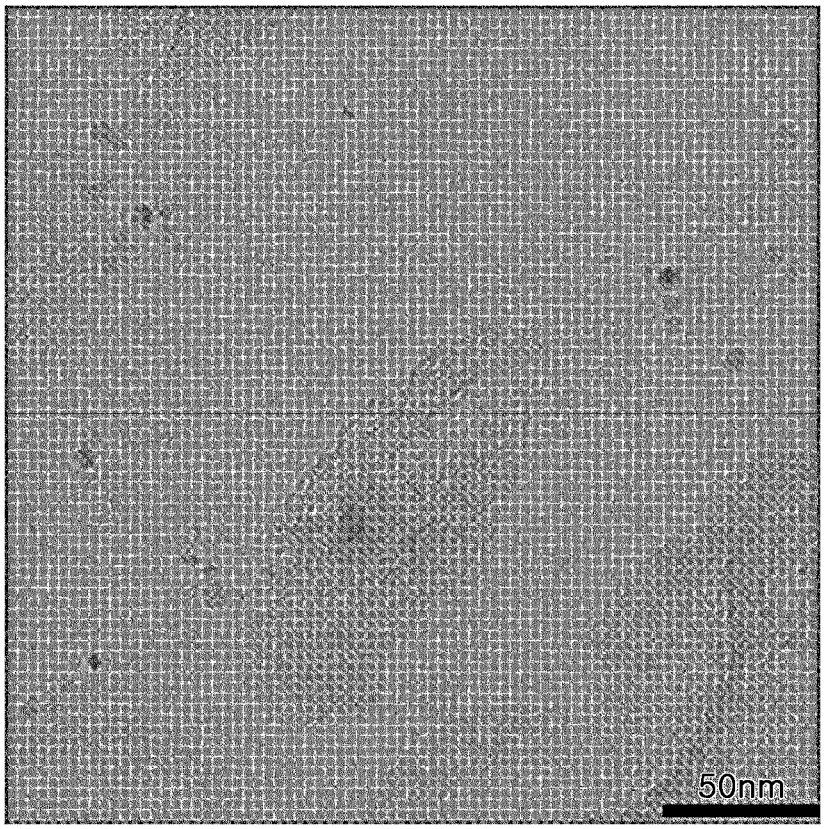

[FIG. 4]
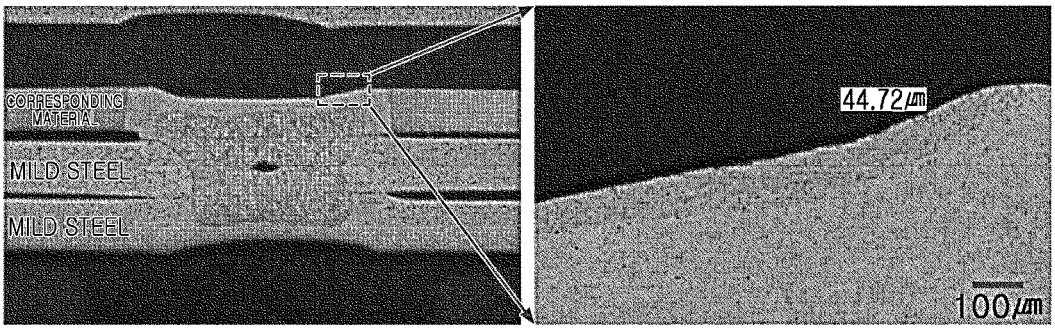

COLD ROLLED STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2022/017337, filed on Nov. 7, 2022, which in turn claims the benefit of Korean Application No. 10-2021-0160095, filed on Nov. 19, 2021, the disclosures of which applications are incorporated by reference herein.

TECHNICAL FIELD

The present disclosure relates to a cold rolled steel sheet and a manufacturing method therefor, and more specifically, to a cold rolled steel sheet having excellent strength and formability that can preferably be applied to a structural member such as a vehicle body member, a seat rail, and a pillar, and a manufacturing method therefor.

BACKGROUND ART

Recently, due to the strengthening of safety regulations for car passengers and pedestrians, the construction of safety devices has become mandatory, and there is a problem of increasing the weight of the vehicle body, which is contrary to the trend for weight reductions in vehicles to improve fuel efficiency. Consumers are increasingly interested in a hybrid or electric vehicle which is eco-friendly and has high fuel efficiency. In order to produce such eco-friendly and safe cars, the weight of a structure of the vehicle body and stability of a material of the vehicle body should be ensured. However, in the hybrid vehicles, in addition to the existing gasoline engine, various devices such as electric engines, electric batteries, secondary fuel storage tanks, and the like are being added. In addition, as driver convenience facilities are continuously added, the weight of the vehicle body is increasing. Accordingly, in order to reduce the weight of the vehicle body, it is essential to develop a material which is thin but has excellent strength, ductility, and bending properties. Therefore, in order to solve this problem, it is necessary to develop a giga-grade steel sheet that can secure high strength and ductility having a tensile strength of 1180 MPa or more.

Meanwhile, as impact safety regulations for vehicles have recently expanded, high-strength steel with excellent yield strength is being used in a structural member such as a member, a seat rail, and a pillar to improve impact resistance of the vehicle body. The structural member has characteristics which are advantageous for absorbing impact energy as the yield strength thereof, as compared to tensile strength, that is, the higher the yield ratio (yield strength/tensile strength) is, is higher. However, in general, as the strength of the steel sheet increases, the elongation decreases, which causes a problem in that formability deteriorates. Therefore, there is a demand for the development of a material having improved high yield ratio, formability, and bending properties, which are important properties when processing parts.

A representative manufacturing method to increase yield strength is to use water cooling during continuous annealing. For example, a steel sheet in which a microstructure thereof is transformed from martensite into tempered martensite may be manufactured by being soaked in an annealing process, and then immersed in water and tempered. A representative prior art reference of this method is Patent Document 1. Patent Document 1 is a technology for manufacturing a steel material, wherein the steel material having a carbon content of 0.18 to 0.3% is continuously annealed and then water cooled to room temperature, followed by an overaging treatment for 1 to 15 minutes at a temperature within a range of 120 to 300° C., the steel material having a martensite volume ratio of 80 to 97% and a remainder of ferrite is manufactured. As described above, when ultra-high strength steel is manufactured by water cooling and then tempering, a yield ratio is very high, but a problem in which shape quality of a coil deteriorates due to temperature deviation in the width and length directions. Thereby, problems such as material defects, reduced workability, and the like depending on the area during roll forming processing may also occur.

Patent Document 2 is a prior art related to improving processability of the high tensile steel sheet. Patent Document 2 relates to a steel sheet comprising a composite structure mainly comprising tempered martensite, and in Patent Document 2, to improve the processability, fine precipitated Cu particles with a particle size of 1 to 100 nm are dispersed inside a structure. However, Patent Document 2 has a problem in that red heat embrittlement due to Cu may occur by adding an excessive Cu content of 2 to 5% in order to precipitate good fine Cu particles, and also has a problem in that manufacturing costs increase excessively.

Patent Document 3 discloses a steel sheet having a microstructure including ferrite as a base structure and 2 to 10% of pearlite by area, the steel sheet having improved strength through precipitation strengthening through addition of carbon-nitride forming elements such as mainly Ti, and grain refinement. Patent Document 3 has an advantage of easily obtaining high strength at a low manufacturing cost, but has a disadvantage that high-temperature annealing should be performed to cause sufficient recrystallization and ensure ductility because a recrystallization temperature increases rapidly due to fine precipitates. In addition, the existing precipitation strengthening steel, which is strengthened by precipitating carbon and nitride in a ferrite matrix, has a problem in that it is difficult to obtain high strength steel of 600 MPa or higher.

As another method, there is a quenching & partitioning (Q&P) method. In the Q&P method, martensite may be secured by rapidly cooling austenite to a temperature between a martensite transformation start temperature Ms and a martensite transformation finish temperature Mf during a heat treatment process, and at the same time, the strength and elongation may be secured by diffusing austenite stabilizing elements such C and Mn into retained austenite at an appropriate temperature. In the Q & P method, the heat treatment process in which steel is heated to a temperature above A3, rapidly cooled below the Ms temperature, and maintained between Ms and Mf temperatures is called 1-step Q & P, and after rapid cooling, the heat treatment process in which steel is reheated to a temperature above Ms and heat treated is called 2step Q & P. For example, in Patent Document 4, a method for retaining austenite through the Q&P heat treatment is described. However, in the Q & P process, precise control of annealing temperature, cooling temperature, and reheating temperature is important, but Patent Document 4 merely explains the concept of Q & P heat treatment, but there are limitations in actual application due to the lack of detailed explanation of specific control methods.

Therefore, in order to solve the above-described problems, there is a need to develop a steel material having ultra-high strength of 1180 MPa or more having a high yield ratio that can be cold formed without occurring cracks even in a 180° full compression bending test.

PRIOR ART DOCUMENT (Patent Document 1) Japanese Patent Publication No. 2528387

(Patent Document 2) Japanese Patent Publication No. 2005-264176

(Patent Document 3) Korean Patent Publication No. 2015-0073844

(Patent Document 4) U.S. Patent Publication No. 2006-0011274

SUMMARY OF INVENTION

Technical Problem

An aspect of the present disclosure is to provide a cold rolled steel sheet having excellent strength and formability and a manufacturing method therefor.

Solution to Problem

According to an aspect of the present disclosure, provided is a cold rolled steel sheet, the cold rolled steel sheet including by weight: C: 0.10 to 0.20%, Si: 0.05 to 0.495%, Al: 0.01 to 0.18%, Mn: 2.4 to 3.5%, Cr: 0.05 to 0.8%, Mo: 0.05 to 0.8%, B: 0.0001 to 0.003%, Nb: 0.005 to 0.07%, Ti: 0.005 to 0.07%, with a remainder of Fe and other unavoidable impurities, wherein the following Relational Expressions 1 to 3 are satisfied, wherein the cold-rolled steel sheet has a microstructure, the microstructure including, by area: fresh martensite: 1 to 11%, one or two of tempered martensite and bainite: 80 to 97%, retained austenite: 1 to 9%, and ferrite: 7% or less (including 0%), and includes at least one of MC, M(C,N), and the composite precipitates thereof (M=Nb, Ti, Si, Cr, Mo, Fe) with an average size of 20 nm or less in a fraction of 50/μm$^2$ or more.

[Relational Expression 1]

$$1120 \le X = 2301 \times C + 287 \times Mn + 1533 \times Nb + 288 \times Cr - 71 \times Si - 84.1 \times Al \le 1380$$

$$0.25 \le Y = C + Si/30 + Mn/20 \le 0.36 \quad \text{[Relational Expression 2]}$$

$$3420 \le X/Y \le 4360 \quad \text{[Relational Expression 3]}$$

where a content of each alloy element in the above Relational Expressions 1 to 3 is % by weight.

According to another aspect of the present disclosure, provided is a method for manufacturing a cold-rolled steel sheet, the method including: heating a slab, by weight: C: 0.10 to 0.20%, Si: 0.05 to 0.495%, Al: 0.01 to 0.18%, Mn: 2.4 to 3.5%, Cr: 0.05 to 0.8%, Mo: 0.05 to 0.8%, B: 0.0001 to 0.003%, Nb: 0.005 to 0.07%, Ti: 0.005 to 0.07%, with a remainder of Fe and other unavoidable impurities, wherein the following Relational Expressions 1 to 3 are satisfied; finish rolling the heated slab so that a finish rolling exit temperature is $A_3$+50° C. to $A_3$+160° C. to obtain a hot-rolled steel sheet; cooling the hot-rolled steel sheet to a temperature of Ms+100° C. to Ms+300° C. and then coiling the hot-rolled steel sheet; cold rolling the coiled hot-rolled steel sheet to obtain a cold-rolled steel sheet; continuously annealing the cold-rolled steel sheet at a temperature within a continuous annealing temperature (SS) range of 800° C. to 860° C.; primarily cooling the continuously annealed cold-rolled steel sheet at an average cooling rate of less than 10° C./s to a primary cooling end temperature (SCS) of 450° C. to 650° C.; secondarily cooling the primarily cooled cold-rolled steel sheet at an average cooling rate of 10° C./sec or more to a secondary cooling end temperature (RCS) of 300° C. to 390° C.; and reheating the secondarily cooled cold-rolled steel sheet to a temperature within a reheating temperature (RHS) range of 400° C. to 540° C.; and wherein, during the continuous annealing, secondary cooling, and reheating, the following Relational Expressions 4 to 6 are satisfied.

[Relational Expression 1]

$$1120 \le X = 2301 \times C + 287 \times Mn + 1533 \times Nb + 288 \times Cr - 71 \times Si - 84.1 \times Al \le 1380$$

$$0.25 \le Y = C + Si/30 + Mn/20 \le 0.36 \quad \text{[Relational Expression 2]}$$

$$3420 \le X/Y \le 4360 \quad \text{[Relational Expression 3]}$$

$$SS - A_3 \ge 5° \text{ C.} \quad \text{[Relational Expression 4]}$$

$$-30° \text{ C.} \ge Ms - RCS \ge 100° \text{ C.} \quad \text{[Relational Expression 5]}$$

$$-30° \text{ C.} \ge RHS - RCS \ge 250° \text{ C.} \quad \text{[Relational Expression 6]}$$

where the content of each alloy element in the above Relational Expressions 1 to 3 is % by weight.

Advantageous Effects of Invention

As set forth above, according to an aspect of the present disclosure, a cold rolled steel sheet having excellent strength and formability and a manufacturing method therefor may be provided.

BRIEF DESCRIPTION OF DRAWINGS

FIG. 1 is a schematic diagram of a welding method performed to measure an average length of LME cracks according to an embodiment of the present disclosure.

FIG. 2 is a photograph of Inventive Example 1 according to an embodiment of the present disclosure observed by SEM.

FIG. 3 is a photograph of Inventive Example 1 according to an embodiment of the present disclosure observed by TEM.

FIG. 4 is a photograph observing a cross-section in a weld zone after LME evaluation for Inventive Example 3 according to an embodiment of the present disclosure.

BEST MODE FOR INVENTION

Hereinafter, a cold-rolled steel sheet according to an embodiment of the present disclosure will be described. First, an alloy composition of the present disclosure will be described. A content of the alloy composition described below refers to % by weight.

Carbon (C): 0.10 to 0.20%

Carbon (C) is a very important element added for solid solution strengthening. In addition, C contributes to strength improvement by combining with precipitation strengthening elements to create fine carbides. When the C content is less than 0.10%, it is very difficult to secure the desired strength.

On the other hand, when the C content exceeds 0.20%, the strength may rapidly increase due to excessive formation of martensite during cooling due to an increase in hardenability, resulting in poor bending workability. In addition, as weldability deteriorates, the possibility of welding defects occurring when processing parts at a customer company increases. Therefore, the C content is preferably in the range of 0.10 to 0.20%. A lower limit of the C content is more preferably 0.11%, and even more preferably 0.12%. An upper limit of the C content is more preferably 0.19%, and even more preferably 0.18%.

Silicon (Si): 0.05 to 0.495%

Silicon (Si) is an element not only contributing to increasing strength, but also an element which is advantageous for securing elongation by suppressing formation of carbides, and distributing carbon rather than forming carbon into carbides during annealing cracking and cooling and being accumulated in retained austenite, thereby allowing the retained austenite to exist an austenite phase at room temperature. When the Si content is less than 0.05%, it may be difficult to sufficiently secure the above-described effect. On the other hand, when the Si content exceeds 0.495%, it is impossible to prevent deterioration of physical properties in a weld zone due to the formation of LME cracks, and surface defects such as red scale are caused, thereby deteriorating the surface properties and plating properties of the steel material. A lower limit of the Si content is more preferably 0.10%, and even more preferably 0.15%. An upper limit of the Si content is more preferably 0.490%, and even more preferably 0.485%.

Aluminum (Al): 0.01 to 0.18%

Aluminum (Al) is not only an element included for deoxidation of a steel material, but also an element which is effective in stabilizing retained austenite by suppressing precipitation of cementite. When the Al content is less than 0.01%, it may be difficult to sufficiently secure the above-described effects. On the other hand, when the Al content exceeds 0.18%, castability of the steel material is impaired. A lower limit of the Al content is more preferably 0.02%, and even more preferably 0.03%. An upper limit of the Si content is more preferably 0.17%, and even more preferably 0.16%.

Manganese (Mn): 2.4 to 3.5%

Manganese (Mn) is an element added to secure strength. When the Mn content is less than 2.4%, it is difficult to secure strength therewith. On the other hand, when the Mn content exceeds 3.5%, a bainite transformation rate is slowed and too much fresh martensite is formed, making it difficult to obtain high hole expandability. In addition, a band structure may be formed due to segregation of Mn, which impairs the material uniformity and formability of the material. A lower limit of the Mn content is more preferably 2.5%, and even more preferably 2.6%. An upper limit of the Mn content is more preferably 3.4%, and even more preferably 3.2%.

Chromium (Cr): 0.05 to 0.8%

Chromium (Cr) is an alloy element added to secure strength and hardenability. When Mn is added alone, a very large amount of Mn should be added, exceeding the range of the Mn content of the present disclosure. This problem can be solved by adding 0.05% or more of Cr. On the other hand, when the Cr content exceeds 0.8%, local corrosion properties may deteriorate, and oxides may be formed on the surface, impairing phosphate treatment properties. A lower limit of the Cr content is more preferably 0.06%, and even more preferably 0.07%. An upper limit of the Cr content is more preferably 0.7%, and even more preferably 0.6%.

Molybdenum (Mo): 0.05 to 0.8%

Molybdenum (Mo) is an element added to secure strength and hardenability. When Mn is added alone, a very large amount of Mn should be added, exceeding the range of the Mn content of the present disclosure. This problem may be solved by adding 0.05% or more of Mo. On the other hand, when the Mo content exceeds 0.8%, phase transformation is suppressed, making it difficult to obtain a bainite structure, and as an expensive element, economic feasibility of the steel sheet deteriorates. A lower limit of the Mo content is more preferably 0.06%, and even more preferably 0.07%. An upper limit of the Mo content is more preferably 0.7%, and even more preferably 0.6%.

Boron (B): 0.0001 to 0.003%

Boron (B) is an element added to secure hardenability. When Mn is added alone, a very large amount of Mn should be added, exceeding the range of the Mn content of the present disclosure. This problem can be solved by adding 0.0001% or more of B. On the other hand, when the B content exceeds 0.0030%, an excessive amount of B is accumulated on the surface, impairing plating adhesion. A lower limit of the B content is more preferably 0.0002%, and even more preferably 0.0003%. An upper limit of the B content is more preferably 0.0025%, and even more preferably 0.0020%.

Niobium (Nb): 0.005 to 0.07%

Niobium (Nb) is an element added to secure strength and refine a microstructure thereof. When the Nb content is less than 0.005%, it is difficult to obtain an effect of improving the strength and refining the microstructure. On the other hand, when the Nb content exceeds 0.07%, recrystallization is delayed due to local grain fixation, thereby impairing uniformity of the microstructure. A lower limit of the Nb content is more preferably 0.010%, and even more preferably 0.015%. An upper limit of the Nb content is more preferably 0.06%, and even more preferably 0.05%.

Titanium (Ti): 0.005 to 0.07%

Titanium (Ti) is an element added to secure strength and refine a microstructure thereof. When the Ti content is less than 0.005%, it is difficult to obtain an effect of improving the strength and refining the microstructure. On the other hand, when the Ti content exceeds 0.07%, castability is impaired due to excessive formation of TiN, and recrystallization is delayed due to local grain fixation, thereby impairing uniformity of the microstructure. A lower limit of the Ti content is more preferably 0.010%, and even more preferably 0.015%. An upper limit of the Ti content is more preferably 0.06%, and even more preferably 0.05%.

Meanwhile, it is preferable that the cold rolled steel sheet of the present disclosure satisfies the above-described alloy composition and at the same time satisfies the following Relational Expressions 1 to 3. In this case, a content of each alloy element in the following Expressions 1 to 3 is % by weight.

[Relational Expression 1]

$$1120 \leq X = 2301 \times C + 287 \times Mn + 1533 \times Nb + 288 \times Cr - 71 \times Si - 84.1 \times Al \leq 1380$$

The above Relational Expression 1 is a component Relational Expression for securing the excellent strength and formability targeted by the present disclosure. When an X value is less than 1200, it is difficult to secure the strength targeted by the present disclosure due to lack of hardenability, and when the X value exceeds 1380, tensile strength may become too high, and hole expandability, bending characteristics, and the like may become inferior. Therefore, the X value is preferably in the range of 1120 to 1380. A lower limit of the X value is more preferably 1130, and even more preferably 1140. An upper limit of the X value is more preferably 1370, and even more preferably 1360.

$$0.25 \leq Y = C + Si/30 + Mn/20 \leq 0.36 \quad \text{[Relational Expression 2]}$$

The above Relational Expression 2 is a component Relational Expression for securing weldability and hardness in a fusion zone. When a Y value is less than 0.25, it is difficult to secure the target hardness in a fusion zone because a welding carbon equivalent is low, and the Y value exceeds 0.36, the hardness in the fusion zone is too high and brittle fracture may occur. Therefore, the Y value of is preferably in the range of 0.25 to 0.36. A lower limit of the Y value of Relational Expression 2 is more preferably 0.26, and even more preferably 0.27. An upper limit of the Y value of Relational Expression 2 is more preferably 0.35, and even more preferably 0.34.

$$3420 \leq X/Y \leq 4360 \quad \text{[Relational Expression 3]}$$

The above Relational Expression 3 is a component Relational Expression for stably securing strength, weldability, and hardness in a fusion zone targeted by the present disclosure at the same time. When the value of X/Y is less than 3420, it is difficult to secure the strength targeted by the present disclosure due to the lack of hardenability, and since a welding carbon equivalent is high, brittle fracturing in the fusion zone may occur. On the other hand, when the value of X/Y exceeds 4360, hardenability may be excessively high and the hole expandability and bending characteristics may be inferior due to a rapid increase in tensile strength, and the welding carbon equivalent may be low, making it difficult to secure the target hardness inin the fusion zone. Therefore, the value of X/Y is preferably in the range of 3420 to 4360. A lower limit of the value of X/Y is more preferably 3440, and even more preferably 3460. An upper limit of the value of X/Y is more preferably 4340, and even more preferably 4320.

The remaining component of the present disclosure is iron (Fe). However, since in the common manufacturing process, unintended impurities may be inevitably incorporated from raw materials or the surrounding environment, the component may not be excluded. Since these impurities are known to any person skilled in the common manufacturing process, the entire contents thereof are not particularly mentioned in the present specification.

Meanwhile, the impurities may include one or more of P, S, Sb, N, Mg, Sn, Sb, Zn, and Pb as tramp elements, and the total amount may be 0.1% or less by weight. The tramp element is an impurity element derived from scrap used as a raw material in a steelmaking process, and when the total amount thereof exceeds 0.1%, it may cause surface cracks of the slab and deteriorate the surface quality of the steel sheet.

The cold-rolled steel sheet of the present disclosure preferably has a microstructure including, by area: fresh martensite (hereinafter referred to as 'F.M'): 1 to 11%, one or two of tempered martensite (hereinafter referred to as 'T.M') and bainite (hereinafter referred to as 'B'): 80 to 97%, retained austenite (hereinafter referred to as 'R.A'): 1 to 9%, and ferrite (hereinafter referred to as 'F'): 7% or less (including 0%). When a fraction of F.M is less than 1% or a fraction of one or two of T.M and B is less than 80%, it is difficult to secure the strength targeted by the present disclosure. On the other hand, when the fraction of F.M exceeds 11% or the fraction of one or two of T.M and B exceeds 97%, elongation and bending characteristics may be inferior. A fraction of R.A should be 1.0% or more to be advantageous in terms of securing elongation, but when the fraction of R.A is less than 9%, it may be difficult to secure strength. When the fraction of F exceeds 7%, it may be difficult to secure the strength targeted by the present disclosure.

It is preferable that the cold-rolled steel sheet according to an embodiment of the present disclosure at least one of MC, M(C,N), and composite precipitates thereof (M=Nb, Ti, Si, Cr, Mo, Fe) with an average size of 20 nm or less in a fraction of 50/$\mu m^2$ or more. The precipitates have the disadvantage in that it is disadvantageous in securing strength and bending properties when the average size of the precipitates exceeds 20 nm or the fraction thereof is less than 50 $\mu m^2$. The size of the precipitates is more preferably 15 nm or less, and even more preferably 10 nm or less. The fraction of the precipitates is more preferably 75 $\mu m^2$ or more, and even more preferably 100 $\mu m^2$ or more.

The cold rolled steel sheet according to an embodiment of the present disclosure provided as described above has a yield strength (YS): 800 to 1200 MPa, tensile strength (TS): 1180 to 1400 MPa, total elongation (T-EL): 5%, uniform elongation (U-EL): 3% or more, yield ratio (YS/TS): 0.60 or more, hole expansion ratio (HER): 20% or more, and may have excellent strength and formability. The yield strength (YS) is more preferably 850 to 1150 MPa, and even more preferably 850 to 950 MPa. The tensile strength (TS) is more preferably 1185 to 1380 MPa, and even more preferably 1190 to 1350 MPa. The total elongation (T-EL) is more preferably 6% or more, and even more preferably 7% or more. The total elongation (T-EL) is more preferably 6% or more, and even more preferably 7% or more. The yield ratio (YR, YS/TS) is more preferably 0.65 or more, and even more preferably 0.70% or more. The hole expansion ratio (HER) is more preferably 22% or more, and even more preferably 25% or more.

Meanwhile, the cold rolled steel sheet of the present disclosure may have a plating layer formed on at least one surface. In the present disclosure, the type of the plating layer is not particularly limited, but for example, the plating layer may be a Zn-based plating layer. In order to use the cold-rolled steel sheet with a plating layer formed in this manner as a vehicle part, spot welding is generally performed. In this case, an alloying inhibition layer formed on a GI steel sheet is melted by welding heat and generated liquid zinc. More specifically, during spot welding, a temperature in a weld zone rises to about 1500° C. or higher within about 1 second, and as a result, base iron and the plating layer are melted and welded. In this case, a temperature of the plating layer rises to 600 to 800° C. in a weld heat-affected zone (HAZ). As a result, Fe diffuses into the plating layer and a part of the plating layer is alloyed into a Fe—Zn alloy layer, and the remainder becomes liquid zinc. The liquid zinc penetrates into grain boundaries of a surface of the base steel sheet, and in this case, when a tensile stress is applied to the HAZ, cracks having a size of approximately tens to hundreds of micrometers are generated, causing brittle fracture, which is called Liquid Metal Embrittlement (hereinafter referred to as 'LME'). In the present invention, an average length of LME cracks is 170 μm or less, and the present invention may have excellent LME resistance. The average length of LME cracks is more preferably 160 μm or less, and even more preferably 150 μm or less.

In addition, the cold rolled steel sheet of the present disclosure may have a hardness (HvFZ) of a fusion zone of 400 to 650 Hv. When the hardness in the fusion zone is less than 400 Hv, sufficient hardness in the fusion zone may not be secured, and the strength in the weld zone may be lowered. On the other hand, when the hardness in the fusion zone exceeds 650 Hv, the hardness in the fusion zone is too high and susceptibility to cracking increases, so the strength of the weld zone and especially the impact absorption energy may be lowered. The hardness in the fusion zone is more preferably 420 to 630 Hv, and even more preferably 450 to 600 Hv.

Hereinafter, a method for manufacturing a cold rolled steel sheet according to an embodiment of the present disclosure will be described.

First, a slab satisfying the above-described alloy composition and Relational Expressions 1 to 3 is heated. Although the slab heating temperature is not particularly limited, but for example, the slab may be heated at a temperature within a range of 1100 to 1300° C. When the slab heating temperature is lower than 1100° C., there may be a disadvantage such as rolling load during rough rolling. When the slab heating temperature exceeds 1300° C., a microstructure may become coarse and there may be a disadvantage such as increased power costs. A lower limit of the slab heating temperature is more preferably 1125° C., and even more preferably 1150° C. An upper limit of the slab heating temperature is more preferably 1275° C., and even more preferably 1250° C. Meanwhile, the slab may have a thickness of 230 to 270 mm.

Thereafter, the heated slab is finish rolled so that a finish rolling exit temperature (hereinafter also referred to as 'FDT') is $A_3$+50° C. to $A_3$+160° C. to obtain a hot-rolled steel sheet. When the finish rolling exit temperature is lower than $A_3$+50° C., there is a high possibility that hot deformation resistance will rapidly increase. When the finish rolling exit temperature exceeds $A_3$+160° C., not only will excessively thick oxidation scale occur, but there is a high possibility that the microstructure of the steel sheet will become coarse. Therefore, the finish rolling exit temperature is preferably in the range of $A_3$+50° C. to $A_3$+160° C. A lower limit of the finish rolling exit temperature is more preferably $A_3$+60° C., and even more preferably $A_3$+70° C. An upper limit of the finish rolling exit temperature is more preferably $A_3$+150° C., and even more preferably $A_3$+140° C. Meanwhile, the $A_3$ temperature can be obtained through Relational Expression 1 below.

[Relational Expression 1]

$$A_3 = 910 - 203 \times C^{1/2} + 44.7 \times Si + 31.5 \times Mo - 30 \times Mn - 11 \times Cr + 400 \times Al + 400 \times Ti$$

Thereafter, the hot rolled steel sheet is cooled to Ms+100° C. to Ms+300° C. and then coiled. When the coiling temperature (hereinafter referred to as 'CT') is lower than Ms+100° C., martensite or bainite is excessively generated, resulting in an excessive increase in the strength of the hot rolled steel sheet, thereby causing a problem such as shape defects due to load during cold rolling. On the other hand, when the coiling temperature e exceeds Ms+300° C., pickling properties may be deteriorated due to an increase in surface scale. Therefore, the coiling temperature is preferably in the range of Ms+100° C. to Ms+300° C. A lower limit of the coiling temperature is more preferably Ms+120° C., and even more preferably Ms+150° C. An upper limit of the coiling temperature is more preferably Ms+280° C., and even more preferably Ms+260° C. Meanwhile, in the present disclosure, the cooling process after the coiling is not particularly limited, but for example, the coiled hot-rolled steel sheet may be cooled to room temperature at a cooling rate of 0.1° C./s or less. Meanwhile, the Ms temperature may be obtained through Relational Expression 2 below.

[Relational Expression 2]

$$Ms = 539 - 423 \times C - 30.4 \times Mn - 7.5 \times Si + 30 \times Al$$

Thereafter, the coiled hot-rolled steel sheet is cold rolled to obtain a cold-rolled steel sheet. In the present disclosure, a reduction rate during the cold rolling is not particularly limited, but for example, the cold rolling may be performed at a reduction rate of 30 to 70%. When the cold rolling reduction rate is less than 30%, recrystallization driving force is weakened, which may cause a problem in obtaining good recrystallization grains, and there is a disadvantage that shape correction is very difficult. On the other hand, when the cold rolling reduction rate exceeds 70%, there is a high possibility that cracks will occur in an edge of the steel sheet, and a rolling load may rapidly increase. Therefore, the cold rolling is preferably performed at a reduction rate of 30 to 70%. Meanwhile, before the cold rolling, pickling may be performed to remove scale or impurities attached to the surface.

Thereafter, the cold rolled steel sheet is continuously annealed at a continuous annealing temperature (hereinafter referred to as 'SS') of 800 to 860° C. The continuous annealing is performed to form austenite close to 100% by heating a steel sheet to an austenite single phase region and use the steel sheet for subsequent phase transformation. When the continuous annealing temperature is lower than 800° C., since sufficient recrystallization and austenite transformation do not occur, the fractions of martensite and bainite to be obtained by the present disclosure after annealing may not be secured. On the other hand, when the continuous annealing temperature exceeds 860° C., productivity may decrease, coarse austenite may be formed and the material may deteriorate, and surface quality, such as peeling of a plating material, may deteriorate. A lower limit of the continuous annealing temperature is more preferably 805° C., and even more preferably 810° C. An upper limit of the continuous annealing temperature is more preferably 855° C., and even more preferably 850° C.

Meanwhile, the continuous annealing temperature is a very important factor in securing the strength targeted by the present disclosure and requires precise control. Therefore, in the present disclosure, it is preferable to satisfy the following Relational Expression 4. When a value of SS-$A_3$ is below 5° C., excessive ferrite transformation occurs and sufficient austenite transformation cannot be secured, making it difficult to secure the target F.M and T.M+B fractions in a final microstructure, thereby reducing the target strength. The value of SS-$A_3$ below is more preferably 10° C. or higher, more preferably 15° C. or higher, and most preferably 30° C. or higher.

$$SS - A_3 \geq 5° \text{ C.} \quad \text{[Relational Expression 4]}$$

In the present disclosure, at an atmosphere during the continuous annealing is not particularly limited, but for example, the continuous annealing may be performed in a gaseous atmosphere comprising, by volume, 95% or more nitrogen and a remainder of hydrogen. When the fraction of nitrogen is less than 95% and a ratio of hydrogen is not increased accordingly, an oxidizing atmosphere may be formed in a furnace and oxides may be formed on the surface of the steel sheet, resulting in poor surface quality. In addition, as a ratio of hydrogen increases, process difficulties such as explosion prevention may increase.

Thereafter, the continuously annealed cold-rolled steel sheet is primarily cooled to a primary cooling end temperature (SCS) of 450 to 650° C. at an average cooling rate of less than 10° C./s. The primary cooling end temperature may be defined as a point at which secondary cooling (quick cooling) is initiated by additionally applying quenching facility that was not applied in primary cooling. In the present disclosure, by dividing the cooling process into primary and secondary processes and performing the process step by step, the temperature distribution of the steel sheet may be made uniform in a slow cooling stage, a final temperature and material deviation may be reduced, and the necessary phase can be obtained. When the primary cooling end temperature exceeds 650° C., an amount of cooling to the secondary cooling end temperature increases, so that the shape of the steel sheet may become poor and a fraction of bainite may decrease compared to the target level. Meanwhile, considering a length of the actual facility, it is difficult that cooling is performed to be lower than 450° C. at a cooling rate of less than 10° C./s, so it is preferable that a lower limit of the primary cooling end temperature is 450° C. When cooling is performed at a cooling rate of 10° C./s or more, the amount of cooling in the secondary cooling increases, so that the final temperature deviation and material deviation increase.

Thereafter, the primarily cooled cold rolled steel sheet is secondarily cooled to a secondary cooling end temperature (RCS) of 300 to 390° C. at an average cooling rate of 10° C./sec or more. In the secondary cooling end temperature, the steel sheet is below a Ms temperature, so that martensite transformation occurs during cooling, and this martensite ultimately becomes tempered martensite and bainite phases through a reheating step, which is a post-process. Since the Ms temperature of the ultra-high strength steel sheet of 1180 MPa grade is mostly 400° C. or lower, in the present disclosure, the secondary cooling end temperature is controlled in the range of 300 to 390° C. When the secondary cooling end temperature is less than 300° C., an amount of martensite transformation is too high, so the strength increases and the elongation becomes insufficient, and the yield strength increases too much, deteriorating formability. On the other hand, when the secondary cooling end temperature exceeds 390° C., sufficient martensite transformation does not occur, making it difficult to obtain the target strength. When the secondary cooling rate is less than 10° C./s, even if the target secondary cooling end temperature is reached, high-temperature phase transformation occurs during cooling, making it impossible to obtain the target fraction of martensite and high strength. A lower limit of the secondary cooling end temperature is more preferably 305° C., and even more preferably 310° C. An upper limit of the secondary cooling end temperature is more preferably 385° C., and even more preferably 380° C. The secondary cooling rate is more preferably 15° C./sec or more, and even more preferably 20° C./sec or more.

Meanwhile, the secondary cooling end temperature is a very important factor in securing the strength targeted by the present disclosure and requires precise control. Therefore, in the present disclosure, it is preferable to satisfy the following Relational Expression 5. When a value of Ms-RCS is lower than −30° C., sufficient martensite transformation does not occur, and bainite transformation increases, making it difficult to secure the target strength. On the other hand, when the value of Ms-RCS exceeds 110° C., martensite is excessively transformed, and as a result, T.M. transformation increases during reheating, making it difficult to obtain the target yield strength. A lower limit of the Ms-RCS value below is more preferably −20° C., and even more preferably −10° C. An upper limit of the Ms-RCS value below is more preferably 105° C., and even more preferably 100° C.

$$-30° \text{ C.} \geq Ms - RCS \geq 100° \text{ C.} \quad \text{[Relational Expression 5]}$$

As mentioned above, the secondary cooling may additionally apply a quenching facility that was not applied in the primary cooling, and in the present disclosure, the type of the quenching facility was not particularly limited, but as a preferred example, a hydrogen quenching facility can be used. More specifically, the hydrogen quenching facility may be in a gaseous atmosphere consisting of, by volume, 50 to 80% hydrogen and a remainder of nitrogen. When the hydrogen fraction exceeds 80%, there may be a disadvantage in that it becomes difficult to manage facility such as explosion control, and when the hydrogen fraction is less than 50%, there may be a disadvantage in that it becomes difficult to utilize the efficient heat transfer characteristics of hydrogen, a light element.

Thereafter, the secondary cooled cold-rolled steel sheet is reheated at a reheating temperature (RHS) range of 400 to 540° C. Through the above process, interphase carbon distribution and additional bainite phase transformation necessary for stabilization of retained austenite are obtained. In the present disclosure, an end point temperature of the heating section is referred to as a reheating temperature (hereinafter also referred to as 'RHS') for convenience. When the reheating temperature is lower than 400° C., the martensite generated during primary cooling may not be tempered, resulting in excessively high strength and poor elongation. On the other hand, when the reheating temperature exceeds 540° C., excessive tempering or bainite transformation is performed during reheating, making it difficult to secure the target strength. A lower limit of the reheating temperature is more preferably 410° C., and even more preferably 420° C. An upper limit of the cooling end temperature is more preferably 530° C., and even more preferably 520° C.

Meanwhile, the reheating temperature is a very important factor in securing the strength targeted by the present disclosure and requires precise control. Therefore, in the present disclosure, it is preferable to satisfy the following Relational Expression 6. When a value of RHS-RCS below is lower than −30° C., excessive martensite transformation is performed and the strength greatly increases, resulting in inferior hole expandability and bending characteristics. On the other hand, if the RHS-RCS value exceeds 250° C., it may be difficult to secure the target tensile strength due to excessive tempering. A lower limit of the following RHS-RCS value is more preferably −25° C., and even more preferably −20° C. An upper limit of the following RHS-RCS value is more preferably 240° C., and even more preferably 230° C.

$$-30^\circ\ C. \geq RHS - RCS \geq 250^\circ\ C. \quad \text{[Relational Expression 6]}$$

Meanwhile, in the present disclosure, the manufacturing method may further include, after the reheating, hot-dip plating the cold-rolled steel sheet in a plating bath at a temperature within a range of 430 to 490° C. When the hot-dip plating temperature is lower than 430° C., it may be difficult to secure uniform plating quality due to a low plating temperature, and when the hot-dip plating temperature exceeds 490° C., a plating amount may be excessive and weldability during resistance spot welding may be deteriorated, and in particular, a risk of liquid metal embrittlement (LME) may increase. A lower limit of the hot dip plating temperature is more preferably 435° C., and even more preferably 440° C. An upper limit of the hot dip plating temperature is more preferably 485° C., and even more preferably 470° C. In the present disclosure, the type of hot-dip plating is not particularly limited, but, for example, the hot-dip plating may be hot dip galvanizing. In addition, in the present disclosure, after the reheating, the cold-rolled steel sheet may be hot-dipped as it is, or cooled to room temperature and then heated again to hot-dip plated.

In addition, the manufacturing method may further include temper rolling the cold rolled steel sheet at a reduction rate of less than 2% after the hot dip plating. The temper rolling is for correcting the shape of the steel sheet and adjusting the yield strength. The temper rolling may be performed after being cooled to room temperature after the hot dip plating.

MODE FOR INVENTION

Hereinafter, the present disclosure will be specifically described through the following Examples. However, it should be noted that the following examples are only for describing the present disclosure by illustration, and not intended to limit the right scope of the present disclosure. The reason is that the right scope of the present disclosure is determined by the matters described in the claims and reasonably inferred therefrom.

Example 1

A molten steel having the alloy composition shown in Table 1 below was prepared and then was subjected to continuous casting to manufacture a slab having a thickness of 250 mm. This slab was heated to a temperature of 1200° C. for 12 hours, then hot rolled and coiled under the conditions shown in Table 2 below to obtain a hot rolled steel sheet having a thickness of 3.0 mm, and then pickled and was subjected to cold rolling at a cold rolling reduction rate of 50%, to obtain a cold rolled steel sheet having a thickness of 1.5 mm. Thereafter, this cold rolled steel sheet continuously annealed, primarily cooled, secondarily was cooled, and reheated under the conditions shown in Tables 2 and 3 below. In this case, the gas used during the continuous annealing was 95% N by volume to 5% H by volume, and the gas used during the secondary cooling was 75% H by volume to 25% N by volume. In this case, gas used during the continuous annealing was 95% N by volume to 5% H by volume, and gas used during the secondary cooling was 75% H by volume to 25% N by volume. A microstructure, precipitates, and mechanical properties of the cold-rolled steel sheet prepared in this manner were measured, and the results thereof were shown in Tables 4 and 5 below. In addition, the cold-rolled steel sheet was hot-dip galvanized at a hot-dip galvanizing bath temperature shown in Table 3 below to form a plating layer, then welded, and hardness in a fused zone and an average length of LME cracks were measured, and then the results thereof were shown in Table 5 below. In this case, as a welding method, Bead On Plate (BOP) welding was performed using a $CO_2$ laser welder under the condition of 6 kW-3 min.

Tensile strength (TS), yield strength (YS), yield ratio (YR), total elongation (T-EL), and uniform elongation (U-EL) were measured through a tensile test in a horizontal direction of rolling, and test specimen specifications having a gauge length of 50 mm and a width of tensile specimen of 15 mm were used. A hole expansion rate was measured according to the ISO 16330 standard, and the hole was sheared with a clearance of 12% using a punch having a diameter of 10 mm diameter.

A fraction of the microstructure was measured using Electron BackScatter Diffraction (EBSD) and XRD. Samples of the precipitates were manufactured using a replica method and observed using a transmission electron microscope (TEM). Meanwhile, in the present disclosure, it was difficult to distinguish between T.M. and B, so it was expressed as the sum of the fractions.

Hardness in a weld zone was measured 5 times at ¼t (t=thickness of a steel sheet) with a load of 500 gf using a Vickers hardness tester and calculated as the average value.

An average length of LME cracks was obtained by sequentially stacking two sheets of steel material (corresponding material) and mild steel plating material (thickness: 2 mm) corresponding to Inventive Example or Comparative Example, as shown in FIG. 1, and then tilted by 5° and then resistance spot welding was performed under the conditions under the ISO18278-2 (2016) conditions (Force: 4.5KN, Welding time: 380 ms, Welding Current: Expulsion generated current—0.2 kA, Holding time: 260 ms) and then measured using an optical microscope. The LME crack length was calculated as an average value obtained by measuring 10 welded specimens.

TABLE 1

| Steel type No. | Alloy composition (weight %) C | Si | Mn | Al | Nb | Ti | B | Cr | Mo | Expression 1 | Expression 2 | Expression 3 |
|---|---|---|---|---|---|---|---|---|---|---|---|---|
| Inventive Steel 1 | 0.16 | 0.48 | 2.75 | 0.05 | 0.035 | 0.020 | 0.0010 | 0.30 | 0.20 | 1241 | 0.31 | 3959 |
| Inventive Steel 2 | 0.15 | 0.40 | 2.80 | 0.08 | 0.031 | 0.020 | 0.0010 | 0.20 | 0.20 | 1207 | 0.30 | 3978 |
| Inventive Steel 3 | 0.14 | 0.35 | 2.90 | 0.05 | 0.035 | 0.024 | 0.0012 | 0.25 | 0.21 | 1236 | 0.30 | 4166 |
| Inventive Steel 4 | 0.15 | 0.49 | 2.75 | 0.06 | 0.036 | 0.016 | 0.0015 | 0.35 | 0.18 | 1230 | 0.30 | 4047 |
| Inventive Steel 5 | 0.13 | 0.45 | 2.95 | 0.04 | 0.035 | 0.025 | 0.0008 | 0.40 | 0.19 | 1255 | 0.29 | 4292 |
| Comparative Steel 1 | 0.08 | 0.40 | 2.50 | 0.05 | 0.015 | 0.020 | 0.0010 | 0.25 | 0.19 | 949 | 0.22 | 4346 |
| Comparative Steel 2 | 0.21 | 0.40 | 3.00 | 0.03 | 0.030 | 0.020 | 0.0010 | 0.20 | 0.20 | 1405 | 0.37 | 3763 |
| Comparative Steel 3 | 0.19 | 0.01 | 3.30 | 0.05 | 0.041 | 0.030 | 0.0010 | 0.20 | 0.20 | 1488 | 0.36 | 4187 |
| Comparative Steel 4 | 0.11 | 0.41 | 2.91 | 0.07 | 0.035 | 0.023 | 0.0020 | 0.01 | 0.15 | 1109 | 0.27 | 4121 |
| Comparative Steel 5 | 0.15 | 0.55 | 2.95 | 0.09 | 0.035 | 0.020 | 0.0010 | 0.21 | 0.20 | 1247 | 0.32 | 3947 |

[Expression 1] $X = 2301 \times C + 287 \times Mn + 1533 \times Nb + 228 \times Cr - 71 \times Si - 84.1 \times Al$
[Expression 2] $Y = C + Si/30 + Mn/20$
[Expression 3] $X/Y$

TABLE 2

| Division | Steel type No. | $A_3$ (° C) | Ms (° C.) | FDT (° C.) | CT (° C.) | SS (° C.) | SS − $A_3$ (° C.) | Primary cooling rate (° C./s) |
|---|---|---|---|---|---|---|---|---|
| Inventive Example 1 | Inventive Steel 1 | 799 | 386 | 921 | 633 | 840 | 41 | 5.8 |
| Inventive Example 2 | Inventive Steel 2 | 809 | 390 | 919 | 648 | 830 | 21 | 5.6 |
| Inventive Example 3 | Inventive Steel 3 | 796 | 390 | 914 | 635 | 840 | 44 | 5.8 |
| Inventive Example 4 | Inventive Steel 4 | 803 | 390 | 912 | 638 | 835 | 32 | 5.7 |
| Inventive Example 5 | Inventive Steel 5 | 796 | 392 | 925 | 658 | 840 | 44 | 5.8 |
| Comparative Example 1 | Comparative Steel 1 | 827 | 428 | 911 | 639 | 835 | 8 | 5.7 |
| Comparative Example 2 | Comparative Steel 2 | 769 | 357 | 872 | 641 | 820 | 51 | 5.4 |
| Comparative Example 3 | Comparative Steel 3 | 759 | 360 | 879 | 658 | 840 | 81 | 5.8 |
| Comparative Example 4 | Comparative Steel 4 | 816 | 403 | 915 | 640 | 825 | 9 | 5.5 |
| Comparative Example 5 | Comparative Steel 5 | 815 | 384 | 910 | 635 | 825 | 10 | 5.5 |

TABLE 3

| Division | Steel type No. | SCS (° C.) | Secondary cooling rate (° C./s) | RCS (° C.) | Ms-RCS (° C.) | RHS (° C.) | RHS − RCS (° C.) | Hot-dip galvanizing plating bath temperature (° C.) |
|---|---|---|---|---|---|---|---|---|
| Inventive Example 1 | Inventive Steel 1 | 580 | 14.2 | 340 | 46 | 460 | 120 | 460 |
| Inventive Example 2 | Inventive Steel 2 | 580 | 14.2 | 340 | 50 | 460 | 120 | 462 |
| Inventive Example 3 | Inventive Steel 3 | 580 | 14.2 | 340 | 50 | 460 | 120 | 459 |
| Inventive Example 4 | Inventive Steel 4 | 580 | 13.0 | 360 | 30 | 460 | 100 | 460 |
| Inventive Example 5 | Inventive Steel 5 | 580 | 14.2 | 340 | 52 | 460 | 120 | 455 |
| Comparative Example 1 | Comparative Steel 1 | 580 | 14.2 | 340 | 88 | 460 | 120 | 462 |
| Comparative Example 2 | Comparative Steel 2 | 580 | 14.2 | 340 | 17 | 460 | 120 | 465 |
| Comparative Example 3 | Comparative Steel 3 | 580 | 15.5 | 320 | 40 | 460 | 140 | 460 |
| Comparative Example 4 | Comparative Steel 4 | 580 | 14.2 | 340 | 63 | 460 | 120 | 461 |
| Comparative Example 5 | Comparative Steel 5 | 580 | 14.2 | 340 | 44 | 460 | 120 | 460 |

TABLE 4

| | Fraction of microstructure (area %) | | | | Precipitates | |
|---|---|---|---|---|---|---|
| Division | T.M + B | F.M | R.A | F | Average size (nm) | Fraction ($\mu m^2$) |
| Inventive Example 1 | 89.1 | 6.3 | 4.6 | 0 | 5.7 | 230 |
| Inventive Example 2 | 88.8 | 6.2 | 4.5 | 0.5 | 6.1 | 216 |
| Inventive Example 3 | 89.7 | 6.3 | 4 | 0 | 5.5 | 210 |
| Inventive Example 4 | 88.5 | 5.9 | 5.6 | 0 | 5.3 | 251 |
| Inventive Example 5 | 87.7 | 7.1 | 5.2 | 0 | 5.6 | 199 |

TABLE 4-continued

| | Fraction of microstructure (area %) | | | | Precipitates | |
|---|---|---|---|---|---|---|
| Division | T.M + B | F.M | R.A | F | Average size (nm) | Fraction ($\mu m^2$) |
| Comparative Example 1 | 82.5 | 1.2 | 4.3 | 12 | 10.5 | 45 |
| Comparative Example 2 | 80.8 | 14 | 5.2 | 0 | 6.7 | 256 |
| Comparative Example 3 | 75.8 | 18 | 6.2 | 0 | 6.5 | 210 |
| Comparative Example 4 | 84.9 | 1.5 | 5.6 | 8 | 5.9 | 247 |
| Comparative Example 5 | 88.6 | 5.6 | 5.8 | 0 | 5.7 | 231 |

TABLE 5

| Division | YS (MPa) | TS (MPa) | YR | T-EL (%) | U-EL (%) | HER (%) | Hardness in fusion zone (Hv) | Average length of LME cracks (μm) |
|---|---|---|---|---|---|---|---|---|
| Inventive Example 1 | 988 | 1275 | 0.77 | 10 | 7.2 | 41 | 559 | 124 |
| Inventive Example 2 | 967 | 1256 | 0.77 | 9.8 | 7.1 | 37 | 540 | 123 |
| Inventive Example 3 | 1062 | 1271 | 0.84 | 10.6 | 8.3 | 51 | 529 | 45 |
| Inventive Example 4 | 885 | 1255 | 0.71 | 10.1 | 8.7 | 40 | 544 | 123 |
| Inventive Example 5 | 1061 | 1290 | 0.82 | 11.2 | 8.9 | 29 | 521 | 115 |
| Comparative Example 1 | 998 | 991 | 1.01 | 12 | 9.2 | 60 | 395 | 86 |
| Comparative Example 2 | 983 | 1468 | 0.67 | 4.6 | 2 | 11 | 660 | 145 |
| Comparative Example 3 | 1279 | 1510 | 0.85 | 4.5 | 2.1 | 9 | 629 | 50 |
| Comparative Example 4 | 960 | 1165 | 0.82 | 11.3 | 9.1 | 42 | 482 | 105 |
| Comparative Example 5 | 916 | 1299 | 0.71 | 10.9 | 7 | 38 | 561 | 175 |

As can be seen from Tables 1 to 5, in Inventive Examples 1 to 5 satisfying the alloy composition, Relational Expressions 1 to 3, and manufacturing conditions proposed by the present disclosure, it can be seen that the microstructure, precipitates, average length of LME cracks, and mechanical properties to be obtained by the present disclosure were secured.

On the other hand, in Comparative Examples 1 to 5 not satisfying the alloy composition or Relational Expressions 1 to 3 proposed by the present disclosure, the microstructure, precipitates, average length of LME cracks, and mechanical properties to be obtained by the present disclosure were not secured.

FIG. 2 is a photograph of Inventive Example 1 observed with a SEM, and FIG. 3 is a photograph of Inventive Example 1 observed with a TEM. As can be seen from FIGS. 2 and 3, in Inventive Example 1, it can be seen that not only does it have the composite structure to be obtained by the present disclosure, but also fine precipitates with an average size of several nms are uniformly distributed.

FIG. 4 is a photograph obtained by observing the cross section of the weld zone after LME evaluation for Inventive Example 3. As can be seen from FIG. 4, in Inventive Example 3, it can be seen that the average length of LME cracks is about 45 μm.

Example 2

In Example 1, molten steel having the alloy composition of inventive steels 1 and 3 was prepared, and then continuously cast to produce a slab with a thickness of 250 mm. This slab was heated to 1200° C. for 12 hours, then hot rolled and coiled under the conditions shown in Table 2 below to obtain a hot-rolled steel sheet with a thickness of 3.0 mm, and then pickled and cold rolled at a cold rolling reduction rate of 50% to obtain a cold-rolled steel sheet with a thickness of 1.5 mm. Thereafter, this cold-rolled steel sheet was continuously annealed, primary cooled, secondary cooled, and reheated under the conditions shown in Tables 6 and 7 below. In this case, the gas used during the continuous annealing was 95% N by volume and 5% H by volume, and the gas used during the secondary cooling was 75% H by volume and 25% N by volume. The microstructure, precipitates, and mechanical properties of the cold-rolled steel sheet manufactured in this manner were measured, and the results thereof were shown in Tables 8 and 9 below. In addition, the cold-rolled steel sheet was hot-dip galvanized at a hot-dip galvanizing bath temperature shown in Table 3 below to form a plating layer, then welded, and hardness in a fusion zone and average length of LME cracks were measured and then the results thereof were shown in Table 9. In this case, as a welding method, Bead On Plate (BOP) welding was performed using a $CO_2$ laser welder under the condition of 6 kW-3 min.

Microstructure, precipitates, average length of LME cracks, and mechanical properties were measured under the conditions described in Example 1.

TABLE 6

| Division | Steel type No. | $A_3$ (° C.) | Ms (° C.) | FDT (° C.) | CT (° C.) | SS (° C.) | SS − $A_3$ (° C.) | Primary cooling rate (° C./s) |
|---|---|---|---|---|---|---|---|---|
| Inventive Example 6 | Inventive Steel 1 | 799 | 386 | 921 | 635 | 835 | 36 | 5.7 |
| Inventive Example 7 | Inventive Steel 3 | 769 | 390 | 922 | 638 | 840 | 44 | 5.8 |
| Inventive Example 8 | Inventive Steel 3 | 769 | 390 | 923 | 625 | 830 | 34 | 5.6 |
| Inventive Example 9 | Inventive Steel 3 | 769 | 390 | 924 | 655 | 840 | 44 | 5.8 |
| Inventive Example 10 | Inventive Steel 3 | 769 | 390 | 920 | 624 | 840 | 44 | 5.8 |
| Comparative Example 6 | Inventive Steel 1 | 799 | 386 | 935 | 635 | 790 | −9 | 4.7 |
| Comparative Example 7 | Inventive Steel 1 | 799 | 386 | 915 | 642 | 795 | −4 | 4.7 |
| Comparative Example 8 | Inventive Steel 3 | 769 | 390 | 914 | 651 | 790 | −6 | 4.7 |
| Comparative Example 9 | Inventive Steel 3 | 796 | 390 | 912 | 638 | 730 | 34 | 3.4 |
| Comparative Example 10 | Inventive Steel 3 | 796 | 390 | 921 | 639 | 730 | 34 | 3.4 |
| Comparative Example 11 | Inventive Steel 3 | 796 | 390 | 931 | 645 | 840 | 44 | 5.8 |
| Comparative Example 12 | Inventive Steel 3 | 796 | 390 | 905 | 640 | 840 | 44 | 5.8 |
| Comparative Example 13 | Inventive Steel 3 | 796 | 390 | 915 | 655 | 840 | 44 | 5.8 |
| Comparative Example 14 | Inventive Steel 3 | 796 | 390 | 921 | 641 | 795 | −1 | 4.7 |

TABLE 7

| Division | Steel type No. | SCS (° C.) | Secondary cooling temperature (° C./s) | RCS (° C.) | Ms-RCS (° C.) | RHS (° C.) | RHS − RCS (° C.) | Hot-dip galvanizing plating bath temperature (° C.) |
|---|---|---|---|---|---|---|---|---|
| Inventive Example 6 | Inventive Steel 1 | 580 | 13.6 | 350 | 36 | 460 | 110 | 465 |
| Inventive Example 7 | Inventive Steel 3 | 580 | 14.2 | 340 | 50 | 460 | 120 | 452 |
| Inventive Example 8 | Inventive Steel 3 | 580 | 13.6 | 350 | 40 | 460 | 110 | 462 |
| Inventive Example 9 | Inventive Steel 3 | 580 | 14.2 | 340 | 50 | 500 | 160 | 460 |
| Inventive Example 10 | Inventive Steel 3 | 580 | 15.4 | 320 | 70 | 460 | 140 | 462 |
| Comparative Example 6 | Inventive Steel 1 | 580 | 14.2 | 340 | 46 | 460 | 120 | 465 |
| Comparative Example 7 | Inventive Steel 1 | 580 | 11.9 | 380 | 6 | 460 | 80 | 468 |
| Comparative Example 8 | Inventive Steel 3 | 580 | 10.7 | 400 | −10 | 460 | 60 | 450 |
| Comparative Example 9 | Inventive Steel 3 | 580 | 18.4 | 269 | 121 | 460 | 191 | 462 |
| Comparative Example 10 | Inventive Steel 3 | 580 | 7.1 | 460 | −70 | 460 | 0 | 452 |
| Comparative Example 11 | Inventive Steel 3 | 580 | 18.1 | 275 | 115 | 460 | 185 | 462 |
| Comparative Example 12 | Inventive Steel 3 | 580 | 18.7 | 265 | 125 | 460 | 195 | 450 |
| Comparative Example 13 | Inventive Steel 3 | 580 | 16.6 | 300 | 90 | 560 | 260 | 460 |
| Comparative Example 14 | Inventive Steel 3 | 580 | 5.0 | 495 | −105 | 460 | −35 | 465 |

TABLE 8

| | Fraction of microstructure (area %) | | | | Precipitates | |
|---|---|---|---|---|---|---|
| Division | T.M + B | F.M | R.A | F | Average size (nm) | Fraction ($\mu m^2$) |
| Inventive Example 6 | 88.8 | 5.9 | 5.3 | 0 | 6.2 | 215 |
| Inventive Example 7 | 88.6 | 5.8 | 5.6 | 0 | 5.6 | 211 |
| Inventive Example 8 | 87.7 | 6.1 | 5.7 | 0.5 | 5.4 | 236 |
| Inventive Example 9 | 88.5 | 6.3 | 5.2 | 0 | 4.9 | 251 |
| Inventive Example 10 | 89.0 | 5.8 | 5.2 | 0 | 5.3 | 231 |
| Comparative Example 6 | 72.0 | 6.9 | 3.1 | 18 | 5.2 | 156 |
| Comparative Example 7 | 74.5 | 6.3 | 3.2 | 16 | 6.1 | 145 |

TABLE 8-continued

| | Fraction of microstructure (area %) | | | | Precipitates | |
|---|---|---|---|---|---|---|
| Division | T.M + B | F.M | R.A | F | Average size (nm) | Fraction ($\mu m^2$) |
| Comparative Example 8 | 73.1 | 6.3 | 3.6 | 17 | 5.8 | 152 |
| Comparative Example 9 | 97.2 | 0.3 | 2.5 | 0 | 6.2 | 251 |
| Comparative Example 10 | 78.4 | 17.0 | 4.6 | 0 | 5.3 | 234 |
| Comparative Example 11 | 97.9 | 0.5 | 1.6 | 0 | 6.9 | 245 |
| Comparative Example 12 | 97.6 | 0.3 | 2.1 | 0 | 5.3 | 236 |
| Comparative Example 13 | 97.8 | 0.2 | 2.0 | 0 | 6.7 | 221 |
| Comparative Example 14 | 60.4 | 18.0 | 4.6 | 17 | 5.6 | 132 |

TABLE 9

| Division | YS (MPa) | TS (MPa) | YR | T-EL (%) | U-EL (%) | HER (%) | Hardness in fusion zone (Hv) | Average length of LME cracks (μm) |
|---|---|---|---|---|---|---|---|---|
| Inventive Example 1 | 935 | 1288 | 0.73 | 9.7 | 7.2 | 42 | 556 | 85 |
| Inventive Example 2 | 1062 | 1271 | 0.84 | 10.6 | 8.0 | 49 | 526 | 51 |
| Inventive Example 3 | 989 | 1291 | 0.77 | 10.1 | 7.8 | 45 | 529 | 52 |
| Inventive Example 4 | 1062 | 1220 | 0.87 | 10.3 | 7.6 | 45 | 523 | 56 |

TABLE 9-continued

| Division | YS (MPa) | TS (MPa) | YR | T-EL (%) | U-EL (%) | HER (%) | Hardness in fusion zone (Hv) | Average length of LME cracks (μm) |
|---|---|---|---|---|---|---|---|---|
| Inventive Example 5 | 1128 | 1258 | 0.90 | 8.9 | 6.3 | 36 | 524 | 41 |
| Comparative Example 6 | 788 | 1344 | 0.59 | 8.0 | 5.2 | 19 | 561 | 93 |
| Comparative Example 7 | 676 | 1362 | 0.50 | 7.9 | 5.2 | 18 | 558 | 101 |
| Comparative Example 8 | 663 | 1425 | 0.47 | 7.1 | 4.5 | 16 | 557 | 125 |
| Comparative Example 9 | 1182 | 1169 | 1.01 | 8.7 | 6.1 | 42 | 560 | 102 |
| Comparative Example 10 | 625 | 1362 | 0.46 | 9.2 | 6.5 | 17 | 561 | 97 |
| Comparative Example 11 | 1200 | 1178 | 1.02 | 7.6 | 5.2 | 65 | 563 | 84 |
| Comparative Example 12 | 1189 | 1165 | 1.02 | 7.6 | 5.6 | 52 | 565 | 59 |
| Comparative Example 13 | 1194 | 1165 | 1.02 | 10.9 | 8.1 | 42 | 555 | 65 |
| Comparative Example 14 | 690 | 1411 | 0.49 | 4.9 | 2.1 | 17 | 550 | 54 |

As can be seen from Tables 6 to 9, in Inventive Examples 6 to 10 satisfying the alloy composition, Relational Expressions 1 to 3, and manufacturing conditions proposed by the present disclosure, it can be seen that the microstructure, precipitates, average length of LME cracks to be obtained by the present disclosure were secured.

On the other hand, in Comparative Examples 6 to 14 satisfying the alloy composition, Relational Expressions 1 to 3, but not satisfying manufacturing conditions proposed by the present disclosure, it can be seen that the microstructure, precipitates, average length of LME cracks to be obtained by the present disclosure were not secured.

While example embodiments have been illustrated and described above, it will be apparent to those skilled in the art that modifications and variations could be made without departing from the scope of the present disclosure as defined by the appended claims.

The invention claimed is:

1. A cold-rolled steel sheet, comprising by weight:

C: 0.10 to 0.16%, Si: 0.05 to 0.495%, Al: 0.01 to 0.18%, Mn: 2.4 to 3.5%, Cr: 0.05 to 0.8%, Mo: 0.05 to 0.8%, B: 0.0001 to 0.003%, Nb: 0.005 to 0.07%, Ti: 0.005 to 0.07%, with a remainder of Fe and other unavoidable impurities, wherein the cold-rolled steel sheet has a tensile strength (TS): 1185 to 1400 MPa, and a yield ratio (YS/TS): 0.70 or more, wherein the cold-rolled steel sheet has a microstructure, the microstructure including, by area: fresh martensite: 1 to 11%, one or two of tempered martensite and bainite: 80 to 97%, retained austenite: 1 to 9%, and ferrite: 7% or less (including 0%), and includes at least one of MC, M(C,N), and their composite precipitates (M=Nb, Ti, Si, Cr, Mo, Fe) with an average size of 20 nm or less in a fraction of 50/μm$^2$ or more, and wherein the cold-rolled steel sheet satisfies following Relational Expressions 1 to 3:

[Relational Expression 1]

$$1120 \le X = 2301 \times C + 287 \times Mn + 1533 \times Nb + 288 \times Cr - 71 \times Si - 84.1 \times Al \le 1380$$

$$0.25 \le Y = C + Si/30 + Mn/20 \le 0.36 \quad \text{[Relational Expression 2]}$$

$$3420 \le X/Y \le 4360 \quad \text{[Relational Expression 3]}$$

where a content of each alloy element in the above Relational Expressions 1 to 3 is % by weight.

2. The cold-rolled steel sheet of claim 1, wherein the impurities are tramp elements, and comprise one or more of P, S, Sb, N, Mg, Sn, Zn, and Pb, and the total amount is 0.1% or less by weight.

3. The cold-rolled steel sheet of claim 1, wherein the cold-rolled steel sheet has a yield strength (YS): 800 to 1200 MPa, a total elongation (T-EL): 5% or more, a uniform elongation (U-EL): 3% or more, a hole expansion ratio (HER): 20% or more.

4. The cold-rolled steel sheet of claim 1, wherein the cold-rolled steel sheet has a plating layer formed on at least one surface.

5. The cold-rolled steel sheet of claim 4, wherein the cold-rolled steel sheet has an average length of LME cracks of 170 μm or less.

6. The cold-rolled steel sheet of claim 4, wherein the cold-rolled steel sheet has a hardness (HvFZ) of 400 to 650 Hv in a fusion zone.

7. The cold-rolled steel sheet of claim 1, comprising by weight: C: 0.10 to 0.15%.

8. The cold-rolled steel sheet of claim 1, comprising by weight: C: 0.10 to 0.14%.

9. The cold-rolled steel sheet of claim 1, comprising by weight: C: 0.10 to 0.13%.

* * * * *